US006264247B1

(12) United States Patent
Lombari et al.

(10) Patent No.: US 6,264,247 B1
(45) Date of Patent: Jul. 24, 2001

(54) FULL FLOW WATER CONNECTOR ASSEMBLY ESPECIALLY SUITABLE FOR USE IN DOUBLE-DIAPHRAGM TANKS

(75) Inventors: Robert Lombari, Smithfield, RI (US); Wolf Joerg, Sharon, MA (US); Fred Snel, Stolwijk (NL)

(73) Assignee: Flexcon Industries, Inc., Randolph, MA (US)

( * ) Notice: Subject to any disclaimer, the term of this patent is extended or adjusted under 35 U.S.C. 154(b) by 0 days.

(21) Appl. No.: 09/104,928

(22) Filed: Jun. 25, 1998

Related U.S. Application Data

(60) Provisional application No. 60/050,875, filed on Jun. 26, 1997.

(51) Int. Cl.[7] ..... F17C 1/02

(52) U.S. Cl. ..... 285/202; 285/204; 220/586

(58) Field of Search ..... 285/202, 201, 285/203, 204, 222, 136.1, 140.1, FOR 144; 4/652, 668, 288; 29/890.036, 890.03 C, 890.043, 890.046, 890.124, 890.125, 890.13, 890.14; 220/586

(56) References Cited

U.S. PATENT DOCUMENTS

| | | | | |
|---|---|---|---|---|
| 1,623,067 | * | 4/1927 | Oakley | 285/203 X |
| 1,689,510 | * | 10/1928 | Wackman | 285/202 |
| 1,799,244 | * | 4/1931 | Parish | 285/202 X |
| 1,939,611 | | 12/1933 | Purvis | 62/1 |
| 2,005,087 | | 6/1935 | Kamack | 29/148.2 |
| 2,031,350 | * | 2/1936 | Evans | 285/204 |
| 2,100,168 | * | 11/1937 | Melrath | 285/204 |
| 2,266,611 | | 12/1941 | Martin et al. | 285/49 |
| 2,447,536 | * | 8/1948 | Robinson | 285/203 |
| 2,651,528 | * | 9/1953 | Robinson | 285/203 |
| 3,754,731 | | 8/1973 | Mackal et al. | 251/145 |
| 3,756,367 | | 9/1973 | Mitchell et al. | 188/352 |
| 3,802,464 | | 4/1974 | Frank et al. | 138/30 |
| 3,881,201 | * | 5/1975 | Richards | 285/288 X |
| 4,344,458 | | 8/1982 | Zahid | 138/30 |
| 4,653,663 | | 3/1987 | Holtsclaw | 220/465 |
| 5,216,316 | | 6/1993 | Ipeinski | 310/338 |
| 5,390,808 | * | 2/1995 | Choma et al. | 285/202 X |
| 5,494,188 | | 2/1996 | Sirosh | 220/590 |
| 5,551,590 | | 9/1996 | Mazur et al. | 220/465 |
| 5,564,756 | * | 10/1996 | Hamilton | 285/222 |

* cited by examiner

*Primary Examiner*—Lynne H. Browne
*Assistant Examiner*—David E. Bochna
(74) *Attorney, Agent, or Firm*—Barry G. Magidoff; Paul J. Sutton

(57) ABSTRACT

A full flow water connector assembly has a connector with prongs of a certain length that are separated by notches. The end of the connector with the prongs is passed through an opening in a diaphragm and the prongs protrude through respective slots in a diffuser/retainer member. The prongs are then bent so as to press the diffuser/retainer member so as to secure the diaphragm and hold the connector assembly together. The diffuser/retainer member has segments between the slots, the segments contacting the notches when the diffuser/retainer member is pressed sufficiently far. The length of the prongs beyond the notches limits the maximum amount of compression that the diffuser/retainer member can exert against the diaphragm material, thereby minimizing the chance of cracking and subsequent failure of the diaphragm material.

12 Claims, 6 Drawing Sheets

FULL FLOW WATER CONNECTOR ASSEMBLY ESPECIALLY SUITABLE FOR USE IN DOUBLE-DIAPHRAGM TANKS

This application claim benefit to provisional application Ser. No. 60/050,875 filed Jun. 26, 1997.

BACKGROUND OF THE INVENTION

1. Field of the Invention

The present invention relates to water connector assemblies. More specifically, the invention relates to full flow water connector assemblies that are useful with double diaphragm tanks, and whose installation does not damage the diaphragm through which the connector assembly is installed.

2. Related Art

Various arrangements are known in the art for fluid connectors, pipe joints, and couplings, including those applicable to tanks having an inner diaphragm of a flexible or an elastomeric material.

Holtsclaw (U.S. Pat. No. 4,653,663) discloses a flexible liner 42 inserted into a storage tank 19 and a clamp assembly for securing the liner 42 to the tank. The clamping assembly includes a rigid base plate 2, an elastomeric base support 4, an elastomeric clamp plate 8, and a rigid clamp plate 6. A mounting plate 16 attached to the surface of the tank 19 supports pipes 12 and 14 which extend through aligned holes through the base plate 2, base support 4, clamp plate 8, and clamp plate 6. See columns 2–4 and FIG. 2.

Frank et al. (U.S. Pat. No. 3,802,464) discloses an air and water impervious flexible bag or diaphragm 5 mounted in a tank 1 which is closed by a head 4. The head 4 is provided with an opening 11 bordered by an annular, downwardly extending flange 12. The diaphragm 5 has a neck formed with an enlarged bead that is sealed between a V-shaped recess formed in the flange 12 and an annular groove formed in the upper surface of an adapter 19. The adapter 19 is also provided with a central bore 27, and a disc 28 is located at the upper end of the bore 27 and is provided with a series of holes 29. A water line 30 is threaded within the lower end of the bore 27. The adapter is clamped in place by a circumferential clamping ring 23.

Purvis (U.S. Pat. No. 1,939,611) discloses a storage and dispensing apparatus for carbon dioxide having a bag 13 clamped to a container wall by a fitting 14 and a nut 15. See page 1.

Mitchell et al. (U.S. Pat. No. 3,756,367) discloses a hydraulic brake system bleeder having a bladder 13 wrapped around a ring 44 and compressed between a flange 42 and an inner tank wall. See column 2 and FIG. 1.

Mackal et al. (U.S. Pat. No. 3,754,731) discloses an inflation manifold valve and flange assembly having a sidewall separated into a plurality of prongs and bent radially outwardly. See columns 3 and 4 and FIGS. 2–7.

Sirosh (U.S. Pat. No. 5,494,188) discloses a fluid impermeable liner 94 disposed inside a shell 84, and an end boss 104 disposed in the adjacent openings 88 and 98 of the shell 84 and the liner 94, respectively. The boss 104 includes a generally cylindrical neck portion 112 which fits in the opening 88, and an annular collar or flange portion 116 extending radially outwardly from the lower end of the neck portion 112. The portion of the liner 94 that surrounds the opening 98 is formed into a dual-lip arrangement which includes an upper lip segment 124 and a lower lip segment 128 which extends from the underside of the upper lip segment 124 radially inwardly under the lower surface of the flange portion 116, and then upwardly into hollow along the inner walls 118 of the flange portion 116. See columns 4–5 and FIG. 4.

Zahid (U.S. Pat. No. 4,344,458) discloses a bladder assembly 18 connected to the shell 11 of a pressure vessel by a mounting stem assembly 22. The mounting stem 22 includes a generally cylindrical body portion 23 having an external thread 24. A radially extending stop flange 25 is formed on the outer surface of the stem 22 spaced from the innermost end 26 of the stem. A compression flange 27 is formed at the innermost end of the stem 22, the spaced flanges 25 and 27 defining an outwardly facing annular groove 28 between them into which the annular lip 30 of the bladder assembly 18 is inserted. See columns 2–3 and FIG. 2.

Martin et al. (U.S. Pat. No. 2,266,611) discloses a pipe connection for the shell 2 of a hot water tank. The connection comprises a fitting 1 secured to the opening 7 of the shell 2 by a weld 3. The fitting has a cylindrical skirt 6 which extends through an opening in a packing washer 10. A metal washer 11 is placed over the packing washer 10. The projection 6 is flared out at the end to engage the flange 12 and cause the washer 11 to uniformly compress against the tank wall. See columns 1–2 and FIGS. 2, 3, and 5.

Mazur et al. (U.S. Pat. No. 5,551,590) discloses a tank 48 having a water impermeable liner or diaphragm 27 and a non-metallic fitting 20 at the aligned openings of the tank 48 and the liner 27. The fitting 20 comprises three components: an internal fitting 46, a grommet 26, and a snap retainer 23. The internal fitting 46 has a central body portion 22 and a flange 28. The grommet 26 is U-shaped with a central opening through which the central body portion 22 of internal fitting 22 is inserted and an annular groove for receiving the lip at the opening of the liner 27. The grommet 26 is held against the inner wall of the tank 48 by the flange 28 of the internal fitting 22. The snap retainer 23 fits over the central body portion 22 on the exterior of the tank 48.

Kamack (U.S. Pat. No. 2,005,087) shows a fitting for a tank.

Ipcinski (U.S. Pat. 5,216,316) shows a material held in place between two domed structures.

However, during installation of certain couplings through bladders or diaphragms made of flexible materials, excessive compression of the diaphragm material accelerates the process by which the material cracks and causes early failure of the diaphragm. It is not believed that known systems have dealt with the problem of preventing application of excessive pressure during installation of couplings. It is to solve this problem that the present invention is directed.

SUMMARY OF THE INVENTION

The present invention provides a full flow water connector assembly for providing water flow across a diaphragm, while safely maintaining the seal separating the two sides of the diaphragm. The assembly has a connector element and a first retainer and a second retainer, compressing a diaphragm gasket, or seal, material between them. The connector has a seal portion extending through an opening through the diaphragm, the seal portion having a plurality of axially extending members extending beyond a plurality of transverse stop surfaces, located intermediate the locator members, and a transverse support member located a predetermined distance below the transverse stop surfaces, on the other side of the diaphragm. The second retainer surrounds the seal portion and rests against the transverse support member; the diaphragm seal material rests on the second retainer and the first retainer presses the diaphragm seal material into the second retainer and against the outer surface of the seal portion. The respective locator members extend through mating openings in the first retainer, and are locked so as to secure the first retainer and maintain the desired predetermined pressure on the diaphragm gasket, which defines the opening through the diaphragm. Significantly, a maximum pressure that the first retainer may exert against the diaphragm gasket is limited by the extent of travel permitted the first retainer, i.e., when the first retainer contacts the transverse stop surfaces; the stop surfaces are at a predetermined distance above the transverse support member on the connector.

The preferred embodiment of the present invention provides a full flow water connector assembly having a connector with a circumferential support flange, and locator prongs that are separated by notches, the notch stop surfaces being a specified distance above the circumferential flange; a second retainer rests upon the flange. The end of the connector including the prongs extends through the gasket opening in the diaphragm, and the locator prongs protrude through respective slots in a diffuser/retainer member, or first retainer. The locator prongs are then swaged so as to press the diffuser/retainer member against the diaphragm gasket, holding the connector assembly together and thus forming a seal.

The preferred diffuser/retainer member has segments between the slots, which are arcuate in shape, the segments contacting the notch stop surfaces when the diffuser/retainer member is pressed sufficiently far. The distance between the notch stop surfaces and the circumferential flange determines the minimum distance between the two retainer opposing surfaces, and thus sets the desired predetermined compression against the diaphragm, and also limits the maximum compression that the diffuser/retainer member can exert against the diaphragm gasket material. This minimizes the chance of cracking and subsequent failure of the diaphragm material, and also provides a visual indication of when the pressure is correct, thus insuring a proper seal.

Other objects, features and advantages of the invention will be apparent to those skilled in the art upon a reading of the following detailed description when read in conjunction with the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

Figure 2:
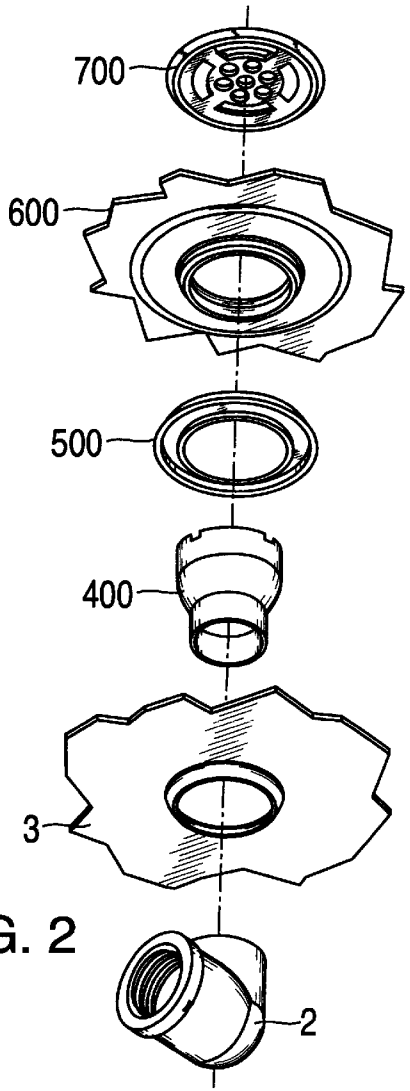
FIG. 2 is an exploded perspective view of a preferred embodiment of the full flow water connector assembly according to the present invention.

Elements of the drawings are intended to be proportionate within any particular drawing of the preferred embodiment, but are not necessarily to scale between different drawings.

DETAILED DESCRIPTION OF THE PREFERRED EMBODIMENTS

In describing the preferred embodiments of the present invention illustrated in the drawings, specific terminology is employed for the sake of clarity. However, the invention is not intended to be limited to the specific terminology so selected, and it is to be understood that each element of the assembly includes all technical equivalents which operate in a similar manner to accomplish a similar purpose.

The following description assumes that the full flow water connector assembly is connected to the bottom of a tank, and descriptors such as "top" and "bottom" are used as relative terms, merely for ease of reference, and not to limit the scope of the invention or the application of its principles. The full flow water connector according to the invention may be used in orientations other than that particularly described herein and shown in the accompanying drawings; it is the geometric relationships among the parts, not the orientation of the assembly, that is crucial.

Figure 1:
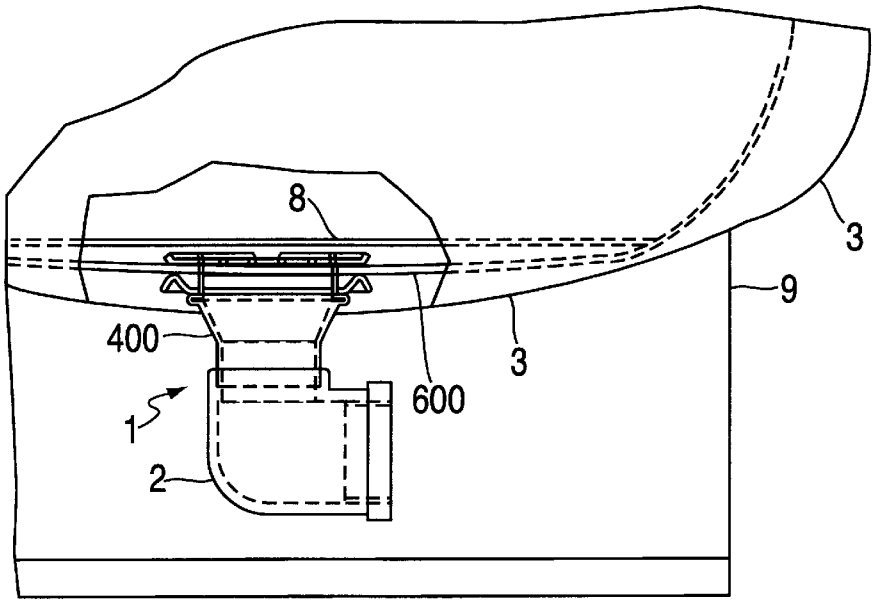
FIG. 1 illustrates a preferred embodiment of the full flow water connector assembly according to the present invention, installed in a double-diaphragm tank.

FIG. 1 illustrates a preferred embodiment of the full flow water connector assembly 1 according to the present invention, installed in a double-diaphragm tank. FIG. 2 is an exploded perspective view of the assembly.

The full flow water connector assembly 1 connects an elbow 2 to the interior volume of a double-diaphragm tank, i.e., the volume defined and sealed by the two diaphragms. The tank includes a dome 3, a first diaphragm 600 having a gasketed opening through a central portion, and a second diaphragm 8. A tank support structure and skirt 9, not essential to the full flow water connector assembly itself, is also illustrated in FIG. 1. Alternatively, and preferably in certain circumstances, the elbow is replaced by a bent pipe, which extends to beyond the skirt 9, where it joins with a flow system through a union coupling. After installation of the full flow water connector assembly, there is a water flow pathway from the volume defined by the pair of diaphragms 600 and 8, through holes in the diffuser/retainer 700, through an opening in the diaphragm 600, past the location of the lower retainer ring 500, and through the full flow connector 400 to the elbow 2.

Figure 3A:
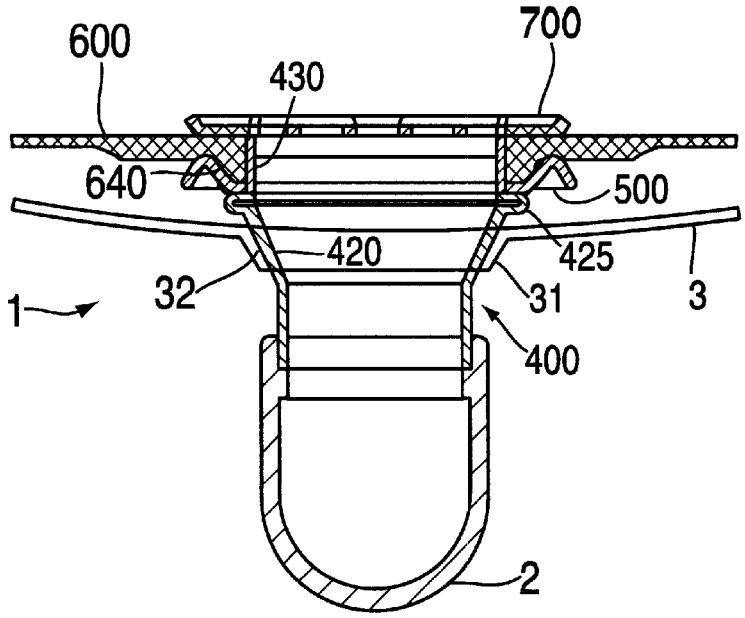
FIGS. 3A and 3B are an end and a side cross-section views of a preferred embodiment of a full flow water connector assembly according to the present invention.
Figure 3B:
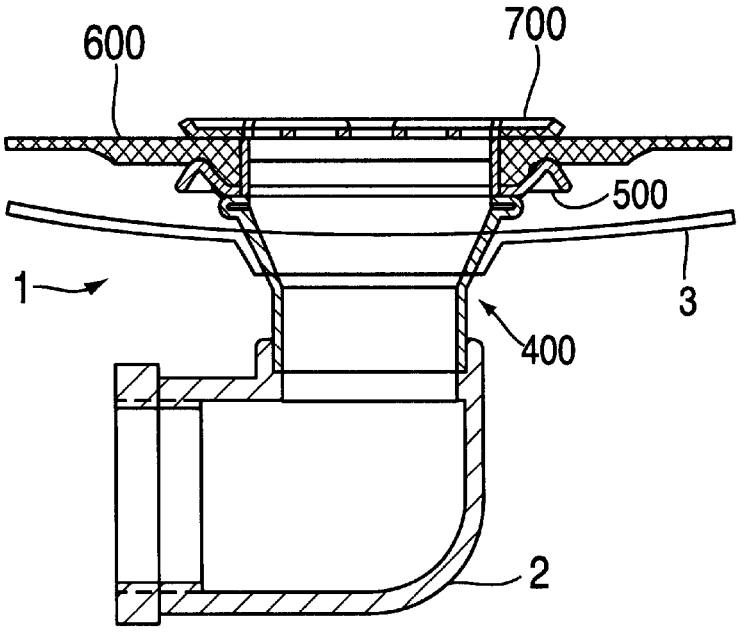

For installation, as shown more clearly in the two side cross-section views of FIGS. 3A and 3B, the lower retainer ring 500 is placed around the top portion 430 of the full flow water connector 400, so that the lower circumferential portion 516 rests on the circumferential flange 425, and the top portion 430 of the connector 400 is inserted through an opening in diaphragm 600 (see FIG. 2). A sealing gasket 640 surrounds the opening through the diaphragm 600; the gasket 640 being held between the lower retainer 500 and the top portion 430. The prongs 431–434 on the top portion of connector 400 are inserted through the arcuate slots 731–734 in the diffuser/retainer 700, and the diffuser/retainer 700 is pressed downwardly until the bottom surfaces of the radial segments 721–724 press against the notch stop surfaces 441–444 between the prongs. The prongs are bent outwardly, or swaged, to secure the diffuser/retainer in place, thereby compressing the diaphragm gasket 640 between the diffuser/retainer 700 and the lower retainer ring 500, to a precise and predetermined compression. Finally, the full flow water connector 400 is welded to both dome 3 to secure the connector in place, and to elbow 2 to seal the water flow path.

Figure 4B:
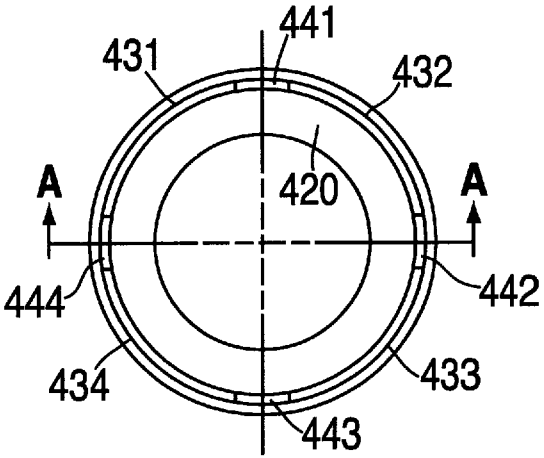
FIGS. 4A—4C are side cross-section and plan views, respectively, of a preferred embodiment of a full flow water connector that is part of the full flow water connector assemble according to the present invention.
Figure 4C:
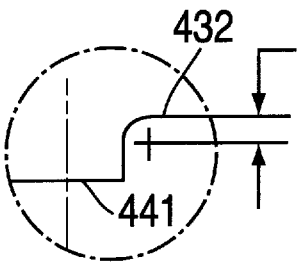
Figure 4A:
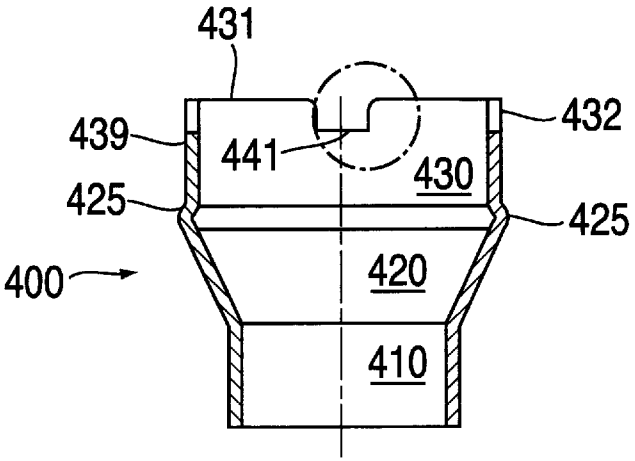

FIGS. 4A and 4B are side cross-section and plan views, respectively, of a preferred embodiment of the full flow water connector 400. A lower, narrower-diameter cylindrical portion 410 is adapted to sealably connect with elbow 2, such as, for example, by welding. A conical portion 420 connects the narrower-diameter cylindrical portion 410 and the wider-diameter cylindrical portion 430. The wider portions 430 and conical portion 420 are separated by the circumferential ridge, or flange, 425 that extends outward from the outer surface.

Preferably, the connector 400 is welded to dome 3 along the conical portion 420; the conical portion 420 is retained within a conical portion 31, formed in the dome 3. This cone-within-cone arrangement is shown in FIGS. 3A and 3B, and provides for proper alignment of the parts of the assembly. In this manner, any downward forces acting on the connector 1 tend to press it further into secure engagement with the dome 3. In the installed connector assembly, the lower retainer ring 500 rests upon the side of the flange portion 425. Thus, flange 425, and the cone-within-cone arrangement of elements 420 and 3, ensure that downward pressure on the assembly cannot force the connector entirely through the hole in the dome, and accurately juxtapose the elements forming the assembly.

The upper wider portion 430 is provided with a series of upwardly-extending prongs 431, 432, 433, 434 whose edges are separated by respective notches 441, 442, 443, 444. As will become clearer from the discussion of FIGS. 7A and 7B, the upper portion 430 of the connector extends through the lower retainer ring 500 and diaphragm 600, and prongs 431, 432, 433, 434 project through respective slots 731, 732, 733, 734 in diffuser/retainer 700. The prongs 431–434 are bent radially outwardly so that the assembly 400, 500, 600, 700 is held together.

Significantly, the distance between the notches surfaces 441, 442, 443, 444 and the circumferential flange 425 is selected to provide the desired predetermined pressure that can be exerted on the diaphragm gasket 640 during installation of the connector assembly; the extent of travel permitted the diffuser/retainer 700 when radial segments 721, 722, 723, 724 contact the respective notches surfaces 441, 442, 443, 444, determines the pressure. This feature also provides a direct visual means of assuring proper compression of the diaphragm seal. In prior arrangements, there has been no such limit on the pressure that might be applied to the diaphragm gasket; as a result, it is difficult to avoid excessive pressure being applied, resulting in brittleness, and early failure of the diaphragm, or, on the other hand, insufficient pressure, resulting in leakage. However, according to the present invention, limiting the pressure applied to the diaphragm during the assembly process helps to prevent the diaphragm gasket 640 from becoming brittle, thus extending its useful life.

Figure 5A:
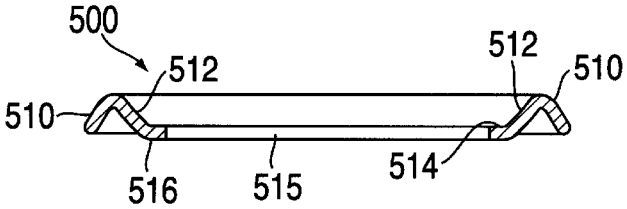
FIGS. 5A and 5B are side cross-section and plan views, respectively, of a preferred embodiment of a lower retainer ring that is part of the full flow water connector assembly according to the present invention.
Figure 5B:
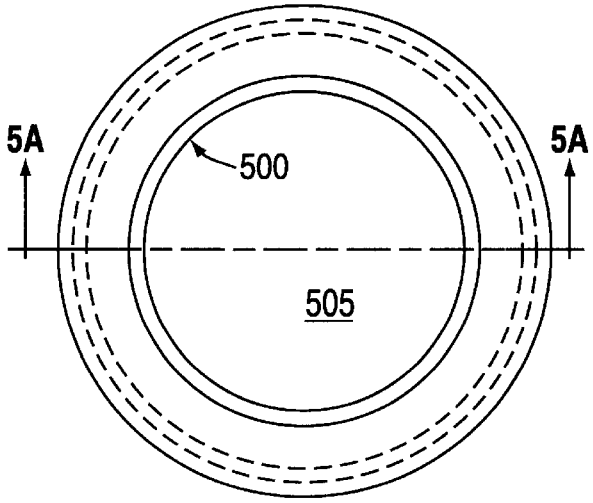

FIGS. 5A and 5B are side cross-section and plan views, respectively, of a preferred embodiment of a lower retainer ring 500 that is part of the full flow water connector assembly according to the present invention. The lower retainer ring 500 is a generally annular metal piece surrounding a central opening 505, defined by the axial surface 515, through which passes the top portion 430 of the full flow water connector 400. As seen most clearly in the side cross-section view of FIG. 5A, the ring is formed of an upwardly-sloped outer ramp 510 that connects with a downwardly-sloped inner ramp 512. Inner ramp 512 connects with a horizontal platform having top surface 514 and bottom surface 516, and axial surface 515. Collectively, the ramp 512 and the platform top surface 514 form a support for a bottom portion of the diaphragm gasket 600.

Figure 6A:
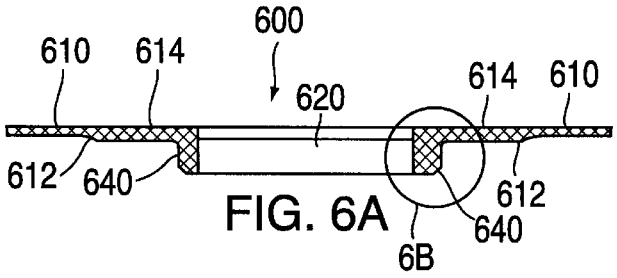
FIG. 6A is a side cross-section view of a preferred embodiment of a diaphragm in the full flow water connector assembly according to the present invention.
Figure 6B:
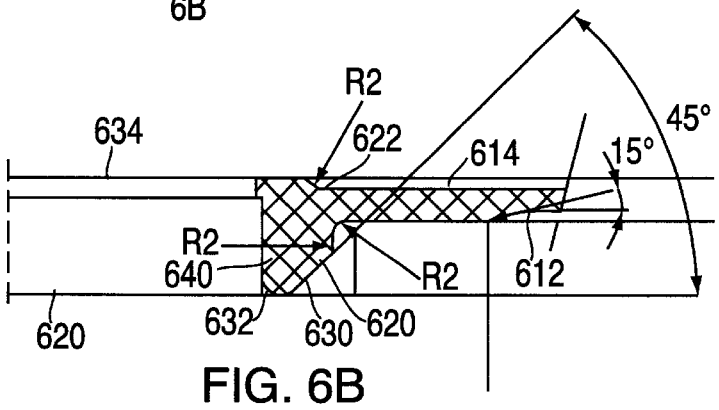
FIG. 6B shows a detail thereof. It is understood that the preferred diaphragm is circumferentially symmetric and therefore no plan view thereof is necessary.

FIG. 6A is a side cross-section view of a preferred embodiment of a diaphragm 600, and FIG. 6B shows a detail of the gasket portion thereof. It is understood that the preferred diaphragm gasket is circumferentially symmetric and therefore no plan view thereof is necessary.

The diaphragm 600 is one of two large nonporous membranes separating a water holding portion of a tank from the atmosphere; the second, distant membrane is shown as diaphragm 8; the two diaphragms 600,8 are joined together within the tank by known means. An opening is provided through the diaphragm 600, defined by a gasket 620, having a cylindrical side wall 640 suitable to allow passage of the top portion 430 of full flow water connector 400. In this case, the gasket 620 is formed integral with the diaphragm material 600. Surrounding the gasket 620 is an annular boundary region 614, having a thickness greater than that of the rest of the diaphragm 600. The boundary region 614 of the diaphragm merges into the thinner major portion of the diaphragm 600 by an annular ramped surface 612. on the lower surface of the diaphragm. In this embodiment, a second ramp 622 is formed on the upper surface, near the outer edge of the gasket region 634, where the gasket region thickness is initially reduced to the thickness of the boundary region 614.

The inner side wall 620 of the gasket material extends downwardly from the main plane of the diaphragm 600. Diaphragm gasket bottom surfaces 630, 632 matingly engage respective top surfaces 512, 514 of the lower retaining ring 500.

Figure 7A:
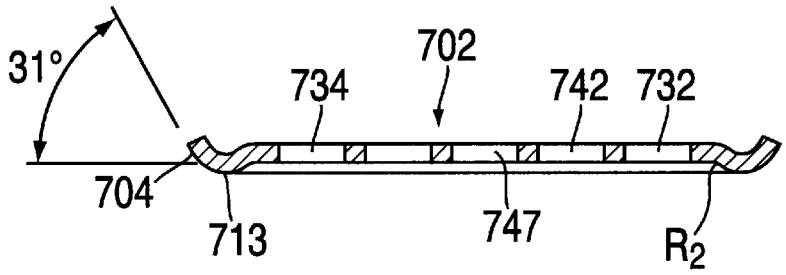
FIGS. 7A and 7B are side cross-section and plan views, respectively, of a preferred embodiment of a diffuser/retainer that is part of the full flow water connector assembly according to the present invention.
Figure 7B:
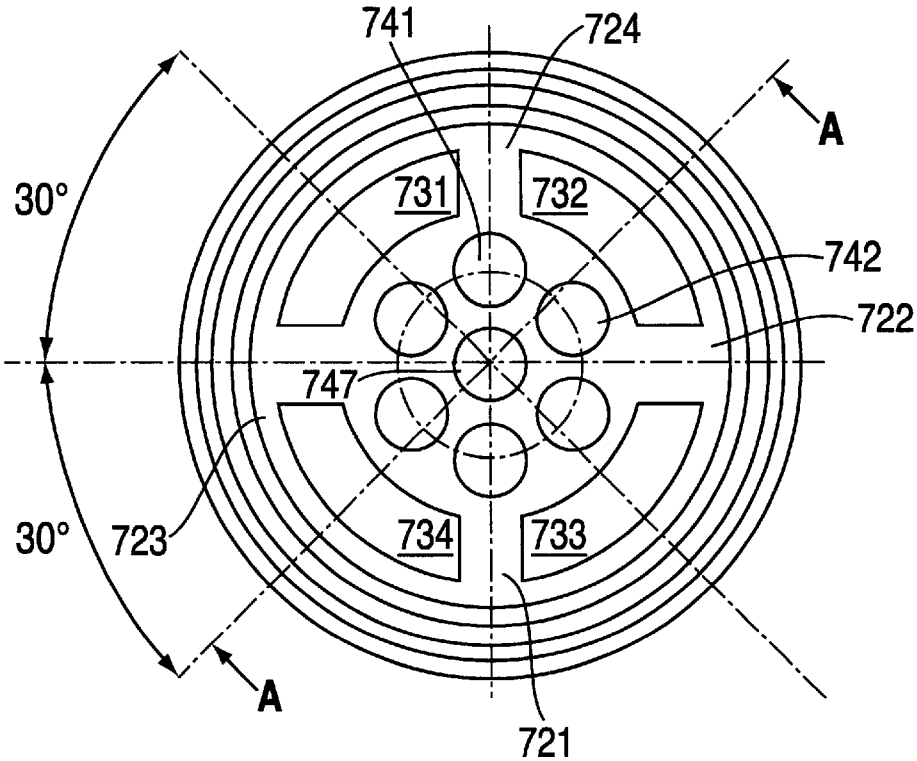

FIGS. 7A and 7B are side cross-section and plan views, respectively, of a preferred diffuser/retainer ring 700. The preferred diffuser/retainer ring has a generally flat, disk-shaped central portion, 702 surrounded by an annular ridge 713 that extends axially downwardly from the flat portion 702. The diffuser/retainer ring's inner area includes a plurality of holes 741–747 for diffusing water, as well as circumferentially-arranged slots 731, 732, 733, 734, that are separated by respective radial segments 721, 722, 723, 724. The slots serve to diffuse water as well as receive the respective prongs 431–434 from the connector 400. The annular circumferential ridge 713 on the diffuser/retainer 700, mates with the annular depression 622, serving to force the gasket 620 against the outer circumferential surface 439 of the flow connector 400.

When the diffuser/retainer 700 is accurately placed on the diaphragm, the connector prongs 431, 432, 433, 434 are inserted upwardly through respective slots 731, 732, 733, 734, and are bent radially outwardly and downwardly so as to press the diffuser/retainer ring 700 into the diaphragm 600. The annular ridge portion 713 is pressed atop the diaphragm gasket portion by the pressure exerted by the bent prongs 431–434, holding the diaphragm in place above the lower retaining ring 500, and forming a tight seal against the outer circumferential surface of the flow connector.

The following provides detailed measurements (in inches unless otherwise noted) of a preferred embodiment of the invention, it being understood that the scope of the invention should not be limited to any particular measurements, configurations, or compositions, except as defined by the claims and their equivalents.

The permitted compressive travel of the retainer ring is a function of the relationship between the thickness of the diaphragm at the location of the compression, and the material of the diaphragm gasket. Suitable materials for the diaphragm include elastomers such as butyl rubber, EPDM, SBR, natural rubber, and silicone rubber, and other compressible elastic materials. Although the example described above shows the gasket as being formed integral with the diaphragm, and of the same material, i.e., butyl rubber, the diaphragm can be formed of a different material, and/or as a separate member, such as an O-ring, made of the elastomers listed above for the diaphragm, or other materials, such as Buna-N, or other commonly used materials for O-rings.

Figure 8:
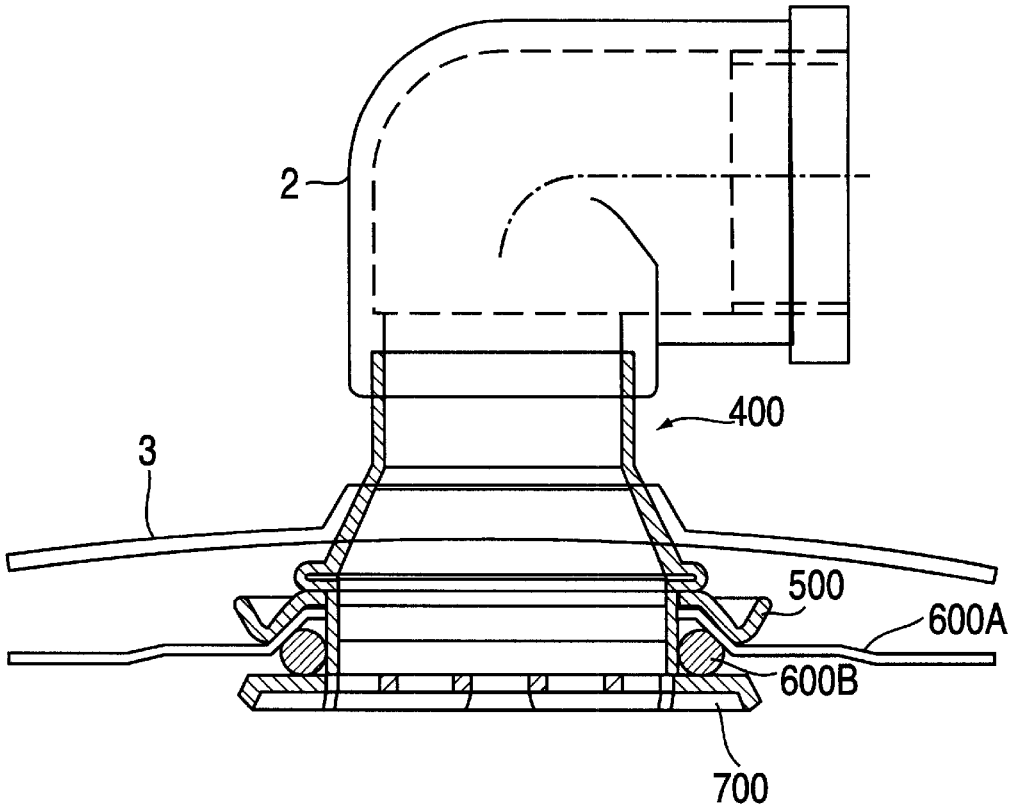
FIG. 8 is a side cross-section view of another embodiment of this invention, with a separate O-ring.

FIG. 8 shows an embodiment where the gasket is an O-ring, made of Buna-N rubber, and the diaphragm is another polymer, such as polyethylene.

The usual travel distance, i.e., the difference between the thickness of the diaphragm gasket section and the full distance between the notch stop surfaces 441–444 and the circumferential flange 425 ("travel distance") is in the range of from about 0.03 to about 0.05 inches for this embodiment. The travel distance can vary depending upon the material selected, and the ratio between the gasket thickness and the full distance and should be less than the height of the prongs.

The full flow water connector has thickness of 0.0650 inches, and is made of 304SS welded tube. The outside diameter of lower portion 410 is 1.3 inches, and the outside diameter of upper portion 430 is 1.8 inches. The middle portion 420 flares at a 25 degree angle between the outer portions 410 and 430. The flange 425 has an outer diameter of 1.9 inches and is 0.1 inch thick. Portions 410, 420 (including flange 425), and 430 have longitudinal lengths of 0.5 , 0.6, and 0.6 inch, respectively. Notches 441–444 are 0.3 inch wide, and prongs 431–434 extend a distance 450 of 0.17 inch.

The lower retainer ring is preferably composed of 0.08-inch thick low carbon steel. Outer ramp 510 is oriented at a 45 degree angle from the horizontal, and inner ramp is oriented at a 60 degree angle from the horizontal. The outer diameter of the outer ramp 510 is 2.7 inches. The inner diameter of the outer ramp, being the outer diameter of the inner ramp 512, is 2.4 inches. The inner diameter of the inner ramp, which is the outer diameter of the flat surface 514, is 2 inches. The inner diameter of flat surface 514, defining the ring's opening 505, is 1.8 inches. The height of the ring is 0.261 inches.

The thickness of the diaphragm 600 in areas 610 distant from the opening is 0.078 inch, with a thickness of 0.12 inch in the boundary area 614. The bottom surface of ramped region 612 is oriented at 15 degrees, from the horizontal, and has an inside diameter of 3.4 inches. The opening has a diameter of 1.8 inches, and the gasket material 640 has an axial length of 0.4 inches. The outer diameter of the downwardly projecting gasket 640 is 2.5 inches.

The preferred diffuser/retainer ring 700 is composed of 304SS steel, of 0.06 inch thickness. Its extreme outer diameter is 2.6 inches. The outer ramp has an inner diameter of 2.4 inches, and slopes upward at a 30 degree angle from the horizontal. The ridge 713 has a height of about 0.04 inches. Diffuser holes 741–747 are 0.30 inches in diameter, with hole 747 being centered in the ring, and with the centers of holes 741–746 located at a radial distance from the center of 0.40 inches. Holes 741–746 are located at regular 60 degree angles circumferentially. Slots 731–734 extend from a radius of 0.663 inches to a radius of 0.91 inches. The slots are located at regular 90 degree intervals circumferentially, separated by the radial segments 721–724 of width 0.3 inches.

Modifications and variations of the above-described embodiments of the present invention are possible, as appreciated by those skilled in the art in light of the above teachings. For example, the orientation, composition, and dimensions of one or more elements of the full flow water connector assembly may vary while still remaining within the scope of the invention; the manner of connecting or joining individual elements to form the assembly can also be varied, e.g., using flanged joints instead of welding. It is therefore to be understood that, within the scope of the appended claims and their equivalents, the invention may be practiced otherwise than as specifically described.

What is claimed is:

1. A full flow water connector assembly for providing water flow across a diaphragm having a first flow side and a second flow side, while safely maintaining the seal separating the two sides of the diaphragm, the assembly comprising a connector, a first retainer, and a diaphragm seal portion defining an opening through the diaphragm; the connector comprising a connector seal portion extending through the opening and a second portion that extends through and is affixed to an outer tank in which the diaphragm is contained, the connector seal portion having an axially extending locator member, a transverse stop surface located adjacent the locator member on the first flow side and axially closer to the diaphragm, and a transverse support element located a predetermined distance from the transverse stop surface, and on the second flow side of the diaphragm, and the locator member extending outwardly from the stop surface away from the diaphragm: the first retainer further including a plurality of diffusion holes therethrough, the first retainer being positioned by the locator member; the locator member being juxtaposed with, and serving to locate the first retainer with respect to the seal portion, the relationship of the axial distance between the transverse support member and the stop surface, to the axial thickness of the diaphragm seal material serves to maintain and limit the desired predetermined pressure on the diaphragm seal material.

2. The assembly of claim 1, wherein the plurality of diffusion holes are located more centrally through the first retainer than the mating openings.

3. A full flow water connector assembly for providing water flow across a diaphragm having a first flow side and a second flow side, while safely maintaining the seal separating the two sides of the diaphragm, the assembly comprising a connector, a first retainer, a second retainer and a diaphragm seal portion defining an opening through the diaphragm; the connector comprising a connector seal portion extending through the opening and a second portion that extends through and is affixed to an outer tank in which the diaphragm is contained, the connector seal portion having an axially extending locator member, a transverse stop surface located adjacent the locator member on the first flow side and axially closer to the diaphragm, a transverse support element located a predetermined distance from the transverse stop surface, and on the second flow side of the diaphragm, and the locator member extending outwardly from the stop surface away from the diaphragm: and the second retainer being located around the seal portion and in contact with the transverse support element, the diaphragm seal portion being retained by the second retainer, wherein the stop surface is axially located intermediate the first and second retainers, the first retainer pressing the diaphragm seal material into the second retainer and against the outer surface of the seal portion; the first retainer being positioned by the locator member; the locator member being juxtaposed with, and serving to locate the first retainer with respect to the seal portion, the relationship of the axial distance between the transverse support member and the stop surface, to the axial thickness of the diaphragm seal material serves to maintain and limit the desired predetermined pressure on the diaphragm seal material.

4. The assembly of claim 3 comprising a plurality of locator members and a plurality of stop surfaces.

5. The full flow water connector assembly of claim 3 comprising a plurality of locator members and stop surfaces, wherein each locator member comprises a prong extending a predetermined distance beyond the stop surfaces; and wherein the first retainer further comprises a plurality of mating openings through each of which a prong extends and the connector assembly is locked together by the prongs being bent so as to secure the first retainer in place, and thus to maintain the pressure on the diaphragm seal material located between the first and second retainers;

wherein the maximum pressure that the first retainer may exert against the diaphragm is limited by the extent of the travel permitted when the first retainer meets the connector's stop surface.

6. The assembly of claim 5, wherein:

the stop surfaces comprise a plurality of transverse surfaces on the connector interposed between successive prongs; and the first retainer has segments between the mating openings, the segments contacting the transverse surfaces so as to limit the degree of travel of the first retainer.

7. A full flow water connector assembly for providing water flow across a diaphragm having a first flow side and a second flow side, while safely maintaining the seal separating the two sides of the diaphragm, the assembly comprising a connector, a first retainer, a second retainer, and a diaphragm seal portion defining an opening through the diaphragm; and the connector comprising a connector seal portion extending through the opening and a second portion that extends through and is affixed to an outer tank in which the diaphragm is contained, the connector seal portion having an axially extending locator member, a transverse stop surface located adjacent the locator member on the first flow side and axially closer to the diaphragm, the second retainer being disposed on a portion of the connector that does not protrude through the diaphragm; and a transverse support element located a predetermined distance from the transverse stop surface, and on the second flow side of the diaphragm, and the locator member extending outwardly from the stop surface away from the diaphragm; the first retainer being positioned by the locator member; the locator member being juxtaposed with, and serving to locate the first retainer with respect to the seal portion, the relationship of the axial distance between the transverse support member and the stop surface, to the axial thickness of the diaphragm seal material serves to maintain and limit the desired predetermined pressure on the diaphragm seal material; and wherein the first retainer and the second retainer immediately surround the diaphragm.

8. A method of installing through a diaphragm contained within an outer tank, a full flow water connector assembly having a connector and first retainer and a second portion that extends through and is affixed to the outer tank, the method comprising:

passing through an opening in the diaphragm, a first portion of the connector having a plurality of prongs that extend a predetermined distance beyond a stop surface on the connector; and passing the prongs through respective slots in the first retainer and bending the prongs so as to secure the first retainer and exert pressure on the diaphragm in a direction from the first retainer toward the stop surface;

wherein a maximum pressure that the first retainer may exert against the diaphragm is limited by a degree of travel permitted when the first retainer meets the connector's stop surface.

9. A full flow water connector assembly having a connector and a first retainer, the assembly being installed through a diaphragm which is contained within an outer tank, by a method comprising:

passing through an opening in the diaphragm, a first portion of the connector having a plurality of prongs that extend a predetermined distance beyond a stop surface on the connector; and passing the prongs through respective slots in the first retainer and bending the prongs so as to secure the first retainer and exert pressure on the diaphragm in a direction from the first retainer toward the stop surface; a second portion of the connector extends through and is affixed to the outer tank;

wherein a maximum pressure that the first retainer may exert against the diaphragm is limited by a degree of travel permitted when the first retainer meets the connector's stop surface.

10. The combination of an outer tank, a diaphragm contained within the outer tank and preventing the flow of water through the diaphragm, and a full flow water connector assembly for providing water flow past the diaphragm, the diaphragm being flexible and formed of a polymeric material, and having a first flow side and a second flow side, the full flow water connector assembly safely maintaining the seal separating the two sides of the diaphragm and preventing passage of a liquid from one side of the diaphragm to the second side, the assembly comprising a connector, a first retainer, and a diaphragm seal portion defining an opening through the diaphragm; and the connector comprising a connector seal portion extending through the opening, the connector seal portion having an axially extending locator member, a transverse stop surface located adjacent the locator member on the second flow side of the diaphragm and axially closer to the diaphragm, and a transverse support element located a predetermined distance from the transverse stop surface, and on the second flow side of the diaphragm, and the locator member extending outwardly from the stop surface away from the diaphragm; the first retainer being positioned by the locator member; the locator member being juxtaposed with, and serving to locate the first retainer with respect to the seal portion, the relationship of the axial distance between the transverse support member and the stop surface, to the axial thickness of the diaphragm seal material serves to maintain and limit the desired predetermined pressure on the diaphragm seal material.

11. The assembly of claim 10, wherein the connector further includes:

a second portion that extends through and is affixed to an outer tank in which the diaphragm is contained.

12. The combination of claim 1, wherein the polymer is a rubbery elastomer.

* * * * *